US008782849B2

(12) United States Patent
Ågren et al.

(10) Patent No.: US 8,782,849 B2
(45) Date of Patent: Jul. 22, 2014

(54) VACUUM CLEANER

(75) Inventors: Christian Ågren, Stockholm (SE); Christer Engström, Åkersberga (SE)

(73) Assignee: AB Electrolux (SE)

( * ) Notice: Subject to any disclaimer, the term of this patent is extended or adjusted under 35 U.S.C. 154(b) by 468 days.

(21) Appl. No.: 13/124,265

(22) PCT Filed: Oct. 5, 2009

(86) PCT No.: PCT/SE2009/000436

§ 371 (c)(1), (2), (4) Date: Aug. 17, 2011

(87) PCT Pub. No.: WO2010/042003

PCT Pub. Date: Apr. 15, 2010

(65) Prior Publication Data

US 2011/0289722 A1 Dec. 1, 2011

Related U.S. Application Data

(60) Provisional application No. 61/106,078, filed on Oct. 16, 2008.

(30) Foreign Application Priority Data

Oct. 10, 2008 (SE) ..... 0802183

(51) Int. Cl.
*A47L 9/14* (2006.01)

(52) U.S. Cl.
USPC ..... 15/347; 15/344

(58) Field of Classification Search
USPC ..... 15/347, 352, 327.2, 344, 328, 329, 331
See application file for complete search history.

(56) References Cited

U.S. PATENT DOCUMENTS

| | | | | |
|---|---|---|---|---|
| 6,428,589 | B1 * | 8/2002 | Bair et al. | 55/318 |
| 2005/0120510 | A1 | 6/2005 | Weber | |
| 2007/0163075 | A1 * | 7/2007 | Butler et al. | 15/410 |
| 2007/0271724 | A1 * | 11/2007 | Hakan et al. | 15/329 |

FOREIGN PATENT DOCUMENTS

| | | |
|---|---|---|
| JP | 2006296985 | 11/2006 |
| WO | WO 2008/023138 | 2/2008 |

* cited by examiner

*Primary Examiner* — Dung Van Nguyen
(74) *Attorney, Agent, or Firm* — RatnerPrestia

(57) ABSTRACT

The present invention relates to an upright vacuum cleaner having a main longitudinal extension, comprising a housing provided with a cavity, which cavity is formed between a bottom portion, and a frame portion, and a dust container comprising a wall and having two lateral sides, wherein the dust container is arranged in the cavity, and wherein the frame portion comprises at least two support bars arranged substantially in the longitudinal direction of the vacuum cleaner, one along each lateral side of the dust container, such that the at least two support bars contribute to the rigidity of the vacuum cleaner while a major portion of the wall of the dust container remains visible.

10 Claims, 1 Drawing Sheet

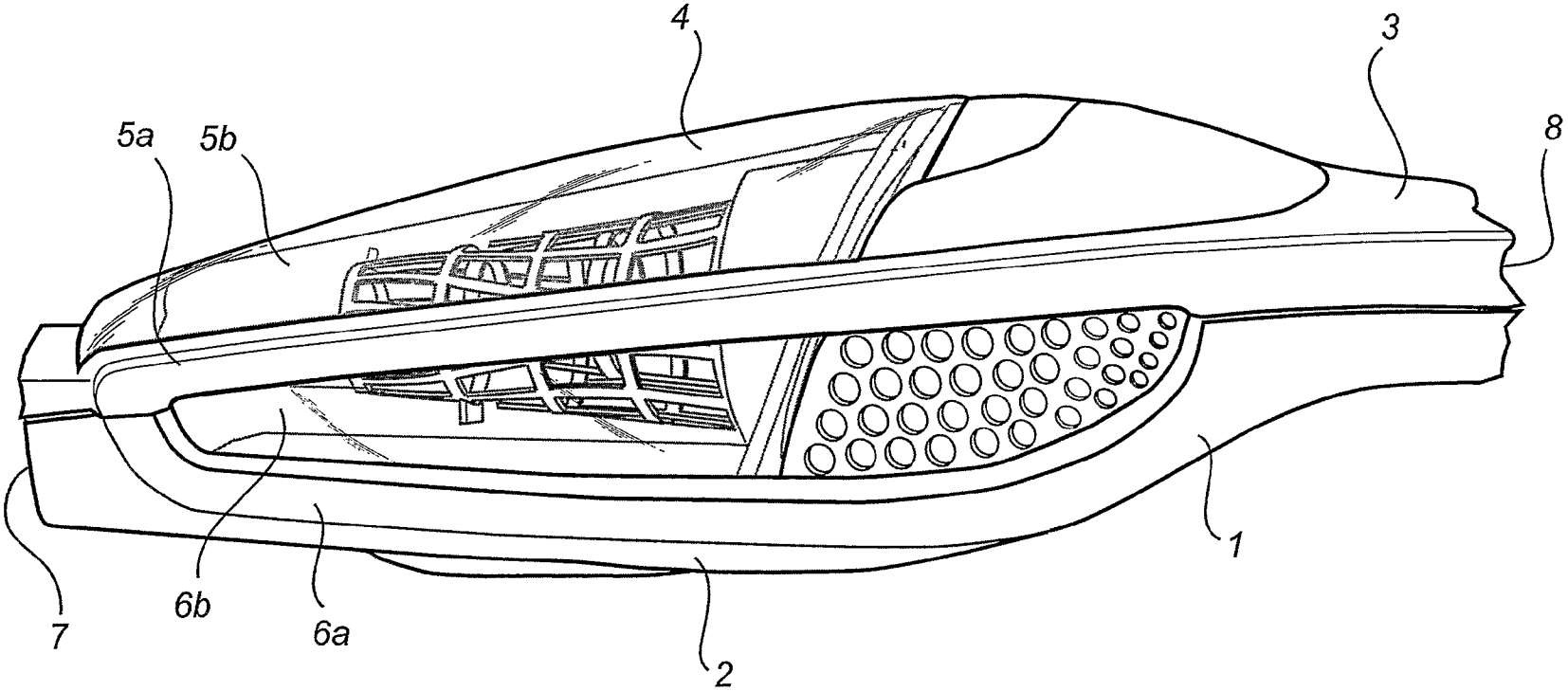
8
3
4
5b
5a
1
2
6a
6b
7

VACUUM CLEANER

This application is a U.S. National Phase application of PCT International Application No. PCT/SE2009/000436, filed Oct. 5, 2009 and claims priority to Swedish Patent Application No. 0802183-4 filed Oct. 10, 2008, and the benefit of U.S. Provisional Application No. 61/106,078 filed Oct. 16, 2008.

FIELD OF THE INVENTION

The present invention relates to an upright vacuum cleaner having a main longitudinal extension, comprising a housing provided with a cavity, wherein the dust container is arranged in the cavity.

BACKGROUND

Modern handheld upright or stick vacuum cleaners often comprise a detachable dust container, which can be removed from the vacuum cleaner for emptying and cleaning. A problem with such vacuum cleaners is that it is difficult to know when the dust container needs to be emptied and that the dust container is often difficult to remove from the vacuum cleaner.

The present invention provides a solution to this problem by provision of a vacuum cleaner according to claim 1.

SUMMARY OF THE INVENTION

It is an object of the present invention to provide an upright vacuum cleaner that at least alleviates at least some of the above-mentioned problems.

According to the present invention, the above object is accomplished by the provision of an upright vacuum cleaner having a main longitudinal extension, comprising a housing provided with a cavity, which cavity is formed between a bottom portion, and a frame portion, and a dust container comprising a wall and having two lateral sides, wherein the dust container is arranged in the cavity, and wherein the frame portion comprises at least two support bars arranged substantially in the longitudinal direction of the vacuum cleaner, one along each lateral side of the dust container, such that the at least two support bars contribute to the rigidity of the vacuum cleaner while a major portion of the wall of the dust container remains visible.

The inventive support bars of the vacuum cleaner of the present invention make it possible to provide a large cavity for accommodating the dust container, without impairing the rigidity of the vacuum cleaner housing. The support bars also allow a large portion of the dust container to be exposed, thus making it easy to identify and access by a user. In an embodiment wherein the dust container is made of a transparent material, the support bars allow facilitated inspection of the contents of the dust container, since they allow a large portion of the dust container walls to be exposed.

Thus, an advantage of the vacuum cleaner of the present invention is that it allows inspection of a major portion of the interior of the dust container, without removing the dust container from the vacuum cleaner, while the rigidity of the vacuum cleaner is substantially unaffected.

The present invention relates to an upright vacuum cleaner or a stick vacuum cleaner. The vacuum cleaner will generally comprise a vacuum generating unit powered by electricity. Electricity may for example be supplied by a mains connection and/or via a battery. The vacuum cleaner may be presented in different shapes and sizes for different applications.

A vacuum cleaner according to the present invention comprises a housing fully or partially encasing the components required for operation of the vacuum cleaner. The vacuum cleaner has a longitudinal extension wherein one end may comprise a suction nozzle for drawing in dirty air, and the other end may comprise a grip or a handle portion for maneuvering the vacuum cleaner during operation. The vacuum cleaner may further comprise a lower shaft connecting the housing to a suction nozzle, and/or an upper shaft connecting the housing to a handle portion.

A vacuum cleaner according to the present invention further comprises a dust container for collecting the dust drawn in with the dirty air. The dust can be separated from the drawn in air by means of any suitable separating method, for example, by using a filter bag or by a cyclone or cyclone-like separating unit.

The housing of a vacuum cleaner according to the present invention comprises a cavity for accommodating the dust container, which cavity is formed between a bottom portion, and a frame portion of the housing. The dust container may be arranged fully or partially inside of the cavity formed in the housing of the vacuum cleaner. The frame portion comprises at least two support bars arranged substantially in the longitudinal direction of the vacuum cleaner, one along each lateral side of the dust container, such that the at least two support bars contribute to the rigidity of the vacuum cleaner while a major portion of the wall of the dust container remains visible.

The support bars of the frame portion combine with the bottom portion to form a cavity in the vacuum cleaner housing. The combination of the support bars and the bottom portion forms a structurally rigid arrangement. This arrangement allows the use of relatively small material dimensions in the bottom portion and support bar construction as compared to a construction based solely on a bottom portion, without the support bars. This arrangement also allows a large portion of the walls of the dust container to remain visible when the dust container is arranged in the cavity of the housing. In an embodiment of the present invention, at least one portion of the dust container wall may be visible between the bottom portion and the first support bar, at least one portion of the dust container wall may be visible between the bottom portion and the second support bar, and at least one portion of the dust container wall may be visible between the first support bar and the second support bar.

The width of the support bars is preferably substantially smaller than the width of the bottom portion of the housing. The width of the support bars is preferably smaller than the width of the windows formed between the support bars and/or between the support bars and the bottom portion.

The present invention also provides a further advantage in that the overall weight of the handheld vacuum cleaner can be reduced due to reduction in the amount of material required for the housing, while still maintaining a high degree of structural rigidity.

Preferably the frame portion comprises at least two support bars, however any number of support bars may be contemplated. In addition to the at least two support bars arranged along the sides of the dust container substantially in the longitudinal direction of the vacuum cleaner, further support bars may be present. For example, in an embodiment of the invention the frame portion may further comprise at least two bottom support bars arranged in the bottom portion along each lateral side of the dust container. Such bottom support bars provide additional torsional rigidity to the vacuum cleaner construction. In a preferred embodiment, each of the two bottom support bars meet one of the two support bars, respectively, such that a closed frame is formed around the opening on each lateral side of the dust container.

The support bars of the frame portion are preferably arranged such that the torsional rigidity of the vacuum cleaner at the cavity is substantially improved. The positioning of the support bars will affect the structural stability of the vacuum cleaner housing. Preferably, the support bars should be placed along the sides of the dust container substantially in the longitudinal direction. This arrangement improves the rigidity of the housing in all directions in the plane orthogonal to the longitudinal extension of the vacuum cleaner.

The support bars may be substantially straight or arched. Arched support bars may provide additional strength and rigidity to the housing construction.

In an embodiment of the invention, wherein the vacuum cleaner further comprises a lower shaft for connecting the housing with a suction nozzle and an upper shaft for connecting the housing with a handle portion, the at least two support bars are preferably substantially aligned with an upper portion of the lower shaft and a lower portion of the upper shaft. This construction is advantageous in that concentrations of stress in or near the support bars can, at least to some extent be avoided, during transmittal of forces between the handle portion and the nozzle.

In an embodiment, the support bars of the frame portion are arranged such that a left side portion and a right side portion of the dust container is visible through an opening between the bottom portion and each support bar, or in other words, the two lateral sides or portions of the dust container are visible through an opening between the bottom portion and each support bar.

In an embodiment wherein the dust container is partially or completely transparent, the support bars of the frame portion may preferably be arranged such that essentially the entire inside wall of the dust container is visible from the outside of the vacuum cleaner.

By choosing the arrangement and the dimensions of the at least two support bars, this inventive construction may allow for the entire inside wall of the dust container to be inspected visually while it is arranged in the cavity of the housing. This is very useful since it allows the detection of dust accumulation anywhere inside the dust container which may impair the performance of the vacuum cleaner.

The dust container may be fully or partially detachable from the vacuum cleaner housing, or it may form an integral part of the vacuum cleaner housing. In a preferred embodiment the dust container is releasably arranged in the housing for enabling removal and emptying thereof.

The dust container comprises at least a wall, which defines the inside volume of the container. The dust container has at least two lateral sides. The wall of the dust container may comprise one or more openings for example for drawing in dirty air, for releasing cleaned air, and/or for emptying the dust container.

The dust container may be of any size and shape suitable for arrangement in an upright or stick vacuum cleaner according to the invention. The dust container may for example be of substantially cylindrical shape or of substantially conical shape. The dust container may be made of rigid or flexible material. The dust container may comprise means for attaching it to the housing, such as indentations or protrusions or other fastening means.

In order to allow easy determination of the filling level of the dust container, it may comprise an inspection window. In order to further facilitate inspection of the dust container, the inspection window may preferably be made as large as possible, thus allowing inspection of a greater portion of the inside of the dust container.

The walls of the dust container may preferably comprise portions of transparent or semi-transparent material. The use of transparent material in the dust container provides an advantage since it allows visual inspection of the contents of the container. In an embodiment, a major portion of the walls of the dust container consists of transparent or semi-transparent material. In another embodiment, the walls of the dust container are made completely of transparent or semi-transparent material.

In a further embodiment of the invention, the dust container is releasably arranged in the housing for enabling removal and emptying thereof. This allows for the dust container to be detached from the vacuum cleaner housing for facilitating emptying and cleaning of the container. Depending on the specific shape of the dust container, release of the container may be effected in any number of ways as is readily recognized by the skilled person.

In an embodiment of the vacuum cleaner of the invention in which the dust container is releasably arranged in the housing, the support bars provide a further advantage in that they may help the user to guide the dust container into the correct position when the container is attached to the housing.

BRIEF DESCRIPTION OF THE DRAWINGS

FIG. 1 represents a side view of the dust container portion of an embodiment of the invention.

DETAILED DESCRIPTION OF A PREFERRED EMBODIMENT

In an embodiment of the present invention as shown in FIG. 1, the upright vacuum cleaner, having a main longitudinal extension, comprises a housing (1) provided with a cavity, which cavity is formed between a bottom portion (2), and a frame portion (3), and a dust container (4) comprising a wall and having two lateral sides, wherein the dust container is arranged in the cavity, and wherein the frame portion comprises at least two support bars (5*a*, 5*b*) arranged substantially in the longitudinal direction of the vacuum cleaner, one along each lateral side of the dust container. The frame portion further comprises at least two bottom support bars (6*a*, 6*b*) arranged in the bottom portion along each lateral side of the dust container. The arrangement of the longitudinal support bars and the bottom portion results in the formation of three transparent windows on the vacuum cleaner housing. The vacuum cleaner also comprises a lower shaft (7), partially shown in FIG. 1, and an upper shaft (8), partially shown in FIG. 1. The lower shaft connects the housing (1) to a suction nozzle (not shown). The upper shaft connects the housing (1) to a handle portion (not shown). The lower shaft is arranged to direct drawn in air containing dust from the suction nozzle into the dust container. The vacuum cleaner further comprises a cyclone or cyclone-like separating unit arranged to separate dust from the air and to direct the dust into the dust container. The housing and/or the dust container further comprises an exhaust vent through which cleaned air is allowed to exit.

The invention claimed is:

1. An upright vacuum cleaner having a main longitudinal extension, comprising a housing provided with a cavity, which cavity is formed between a bottom portion, and a frame portion of the housing, and a dust container comprising a wall and having two lateral sides, wherein the dust container is arranged in the cavity, and wherein the frame portion comprises at least two support bars arranged substantially in the longitudinal direction of the vacuum cleaner, one along each lateral side of the dust container, such that the at least two support bars contribute to the rigidity of the vacuum cleaner while a major portion of the wall of the dust container remains visible and wherein the frame portion further comprises at least two bottom support bars arranged in the bottom portion along each lateral side of the dust container.

2. An upright vacuum cleaner according to claim 1, wherein the dust container is made, at least partially, of a transparent or semi transparent material.

3. An upright vacuum cleaner according to claim 2, wherein the support bars of the frame portion are arranged such that essentially the entire inside wall of the dust container is visible from the outside of the vacuum cleaner.

4. An upright vacuum cleaner according to claim 1, wherein the dust container is made completely of a transparent or semi transparent material.

5. An upright vacuum cleaner according to claim 1, wherein the support bars of the frame portion are arranged such that the torsional rigidity of the vacuum cleaner at the cavity is substantially improved.

6. An upright vacuum cleaner according to claim 1, further comprising a lower shaft for connecting the housing with a suction nozzle and an upper shaft for connecting the housing with a handle portion, wherein the at least two support bars are substantially aligned with an upper portion of the lower shaft and a lower portion of the upper shaft.

7. An upright vacuum cleaner according to claim 1, wherein the support bars of the frame portion are arranged such that a left side portion and a right side portion of the dust container is visible through an opening between the bottom portion and each support bar.

8. An upright vacuum cleaner according to claim 1, wherein each of the two bottom support bars meet one of the two support bars, respectively, such that a closed frame is formed around the opening on each lateral side of the dust container.

9. An upright vacuum cleaner according to claim 1, wherein the dust container is releasably arranged in the housing for enabling removal and emptying thereof.

10. An upright vacuum cleaner according to claim 1, wherein said upright vacuum cleaner is a stick vacuum cleaner.

* * * * *